United States Patent [19]

Kleefeldt

[11] 4,165,112

[45] Aug. 21, 1979

[54] MOTOR-VEHICLE DOOR LATCH

[75] Inventor: Frank Kleefeldt, Heiligenhaus, Fed. Rep. of Germany

[73] Assignee: Arn. Kiekert Söhne, Heiligenhaus, Fed. Rep. of Germany

[21] Appl. No.: 911,949

[22] Filed: Jun. 2, 1978

[30] Foreign Application Priority Data

Jun. 4, 1977 [DE] Fed. Rep. of Germany ..... 2725345

[51] Int. Cl.[2] ..... E05C 3/26

[52] U.S. Cl. ..... 292/216; 292/341.12; 292/DIG. 40

[58] Field of Search ..... 292/216, 341.12, 341.13, 292/DIG. 40, 340

[56] References Cited

U.S. PATENT DOCUMENTS

| | | | |
|---|---|---|---|
| 1,893,639 | 1/1933 | Stutson | 292/DIG. 39 |
| 4,036,517 | 7/1977 | Talmadge | 292/216 |
| 4,097,078 | 6/1978 | Tach et al. | 292/216 |

*Primary Examiner*—Richard E. Moore
*Attorney, Agent, or Firm*—Karl F. Ross

[57] ABSTRACT

A motor-vehicle door latch has an eye-type bolt formed of a U-section piece of sheet steel and having upper and lower sides tapered to each other. A latch housing mounted on the motor-vehicle door has an elastomeric guide forming an upwardly seat having a pair of relatively inclined sides that can fit complementarily over the bolt. A locking fork is pivotal in this latch housing to engage through a vertically throughgoing hole in the bolt and hold it tightly in place.

10 Claims, 5 Drawing Figures

MOTOR-VEHICLE DOOR LATCH

FIELD OF THE INVENTION

The present invention relates to a latch for the door of a motor vehicle.

BACKGROUND OF THE INVENTION

Safety and the law require that a motor-vehicle door latch hold the door extremely securely. To this end a heavy-duty door latch is provided which frequently locks one element on the door completely through another element on the doorpost.

In order to insure proper functioning of such a heavy-duty structure various centering devices are provided to insure that the door always assumes the exact same position relative to the doorpost when closed. Such formations normally include a pin carried on the door and a recess in the doorpost, or vice versa. Both the pin and the recess are complementarily tapered in the direction the door moves as its closes to insure accurate fitting-together of the two parts.

A problem with such an arrangement is that the door must be extremely meticulously mounted on the vehicle in order to insure proper interengagement and alignment of the various parts that allow the latch to function. Any misalignment, in particular a shifting of the door or doorposts longitudinally in the direction of travel of the vehicle, normally makes it impossible for the latch to function. Such shifting can be the simple result of wear-and-tear or the result of an accident. In either case substantial repairs must be made before the essential door latch can be used again.

OBJECTS OF THE INVENTION

It is therefore an object of the present invention to provide an improved motor-vehicle door latch.

Another object of the invention is to provide such a door latch which is simple and inexpensive to construct, yet as secure and safe as any prior-art latch.

A further object is to provide such a door latch which will operate even after limited relative shifting of the door and doorpost.

SUMMARY OF THE INVENTION

These objects are attained according to this invention in a motor-vehicle door latch wherein at least one elastomeric guide is provided in the latch housing to form therein an outwardly open and outwardly flared seat having a pair of relatively inclined generally straight sides. A locking fork is pivotal in this housing between a freeing position clear of the seat and a locking position extending at least partially across the seat. Finally a bolt is mounted on the motor-vehicle doorpost and is formed of a U-section metal plate having a pair of legs inclined like the seat sides toward each other and inwardly toward the housing, and a bight joining these legs. This bolt is snugly fittable within this seat of the housing with its legs snugly engaging the sides thereof. At least one of these sides is formed with a recess in which the fork is engageable in the locking position thereof.

According to further features of this invention the bolt is provided between its legs with an elastomeric body which projects horizontally inwardly and outwardly therefrom. The housing is also provided with an elastomeric bumper at the base of the seat which is engageable with the elastomeric body of the bolt. Thus when the bolt is fitted fully into the seat the two elastomeric bodies will be tightly engaged against each other to insure a snug and rattle-free fit.

According to yet another feature of this invention the fork has a pair of arms one of which is engageable completely through the bolt in the locking position. This fork is formed so that as the door is closed the bolt first engages its inner arm to pivot the form so that its outer arm pokes through the hole extending vertically through the bolt. Below the seat there is provided in the housing a guide slot into which the ends of the arms engage in the locking position, and the pawl at this region holds them in place. Lock mechanisms well known in the art control the operation of the pawl.

Thus with the system according to the invention a single eye-type bolt acts not only as the principal locking member but also as the centering device for the doorpost. The complementary tapers of the seat and the bolt insure good fitting-together of these two parts.

Furthermore according to this invention the hole through the bolt is several times wider than the latch arm that fits through it and the planes of the upper and lower legs of the bolt meet at a horizontal line, as do the planes of the upper and lower guide surfaces of the seat. Thus considerable horizontal shifting of the bolt relative to the seat is possible without impairing the locking function. The latch is originally set up so that the locking arm of the fork lies in the middle of the vertically throughgoing hole so that shifting of the door in either longitudinal direction, forwardly or backwardly in the direction of the travel of the vehicle, need not require resetting of the lock. Limited vertical displacement is compensated for by the tapered shapes of the bolt and the seat which automatically fit them together in the proper fashion.

SPECIFIC DESCRIPTION

Figure 4:
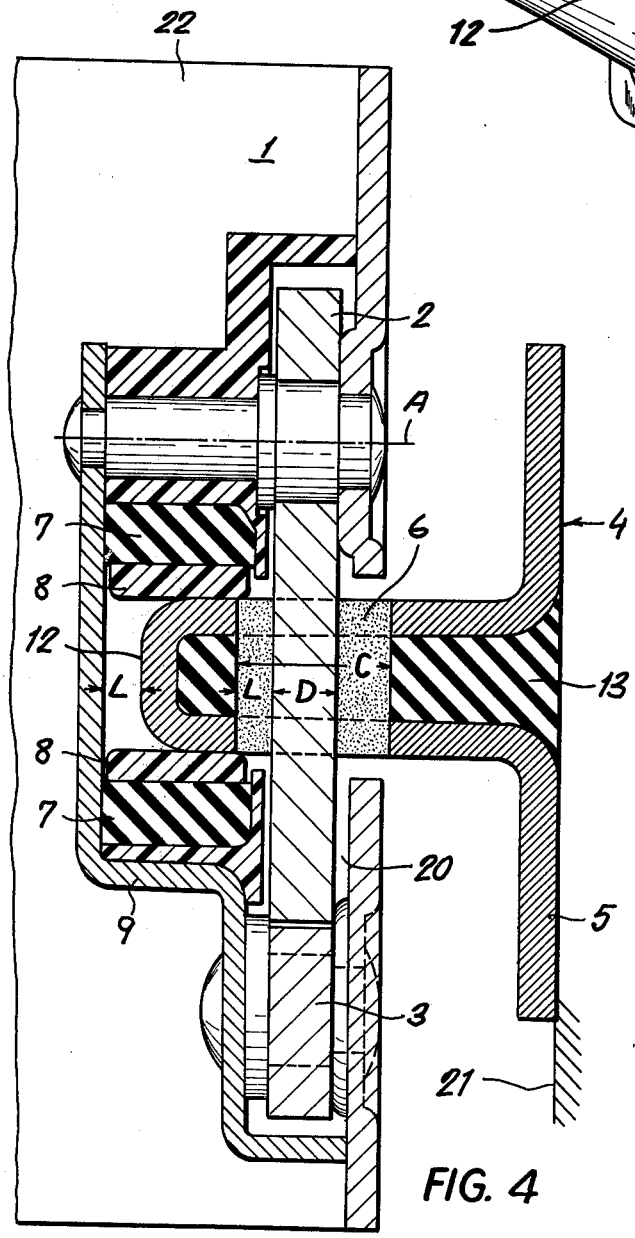
FIG. 4 is a section taken along line IV—IV of FIG. 3.

As shown in FIGS. 1–5 a motor-vehicle door latch basically comprises a bolt 4 normally mounted on a door post such as shown schematically at 21 in FIG. 4 and a latch housing 1 normally secured on the corresponding edge of the motor-vehicle door shown at 22 in FIG. 4. Inside the housing 1 there is provided a double-arm latch fork 2 pivotal about an axis A normally parallel to the direction of travel of the motor vehicle, and a latching pawl 3 that is in turn operated by mechanism known in the art and described in other commonly owned copending patent applications.

Figure 5:
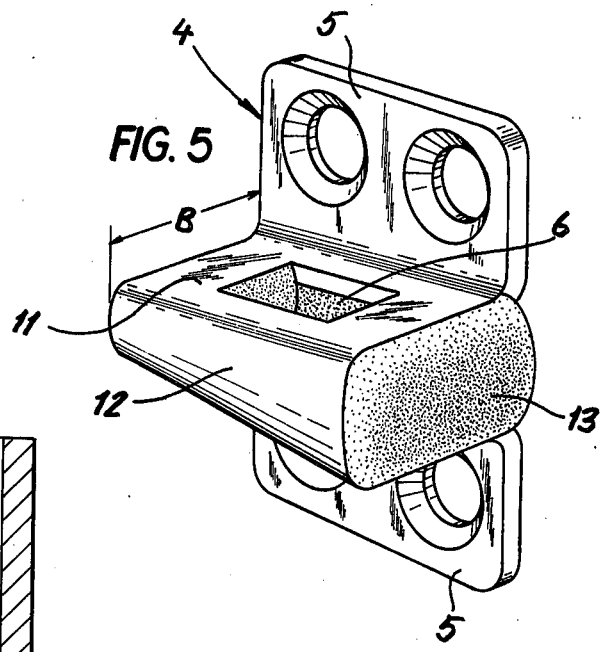
FIG. 5 is a small-scale perspective view of the latch bolt according to this invention.

In accordance with the invention the bolt 4 as shown in perspective in FIG. 5 basically is formed of a steel plate bent into the shape of a U or Ω, that is with a pair of sides 11 joined by a bight 12, and with a pair of laterally projecting flanges 5. The flanges 5 are coplanar and are normally bolted to the edge of the door post. The two sides or flanks 11 are both planar and perpendicular to the respective flanges 5. They are inclined toward one another at an angle of between 10° and 20°, here 16°, and bisected by a horizontal plane P extending in the direction of the travel of the motor vehicle. The bolt 4 is therefore tapered inwardly, that is toward the door. Furthermore the legs or flanks 11 of the bolt 4 are formed with vertically aligned throughgoing holes 6 through which the fork 2 may engage as will be described in greater detail below. Finally the space between the two sides or flanks 11 and the bight 12 is filled except at the hole 6 with an annular elastomeric body 13 that projects both at the outer edge 14 of the bolt 4 and inner edge 15 thereof. This body 13 is made of a durable and elastic synthetic resin.

The latch itself is formed with an outwardly flared seat or recess 10 complementary to the bolt 4 and having guide surfaces 8 defined by low-friction liner walls resting on bumpers 7 themselves bearing on walls or sides 9 of the housing 1. At the base of the seat 10 there is provided another bumper 16 against which the elastomeric body 13 can be engaged.

Figure 1:
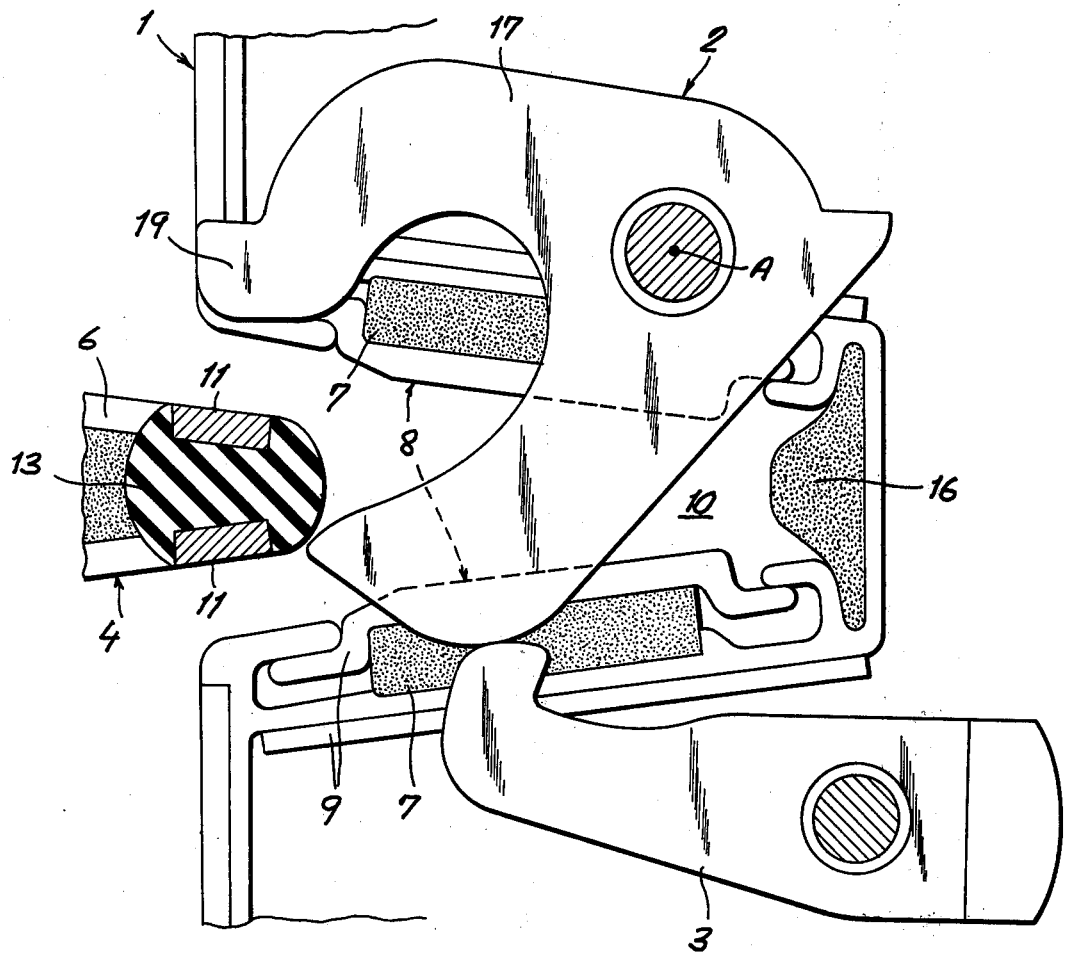
FIG. 1 is a side sectional view of the latch according to this invention when open.
Figure 2:
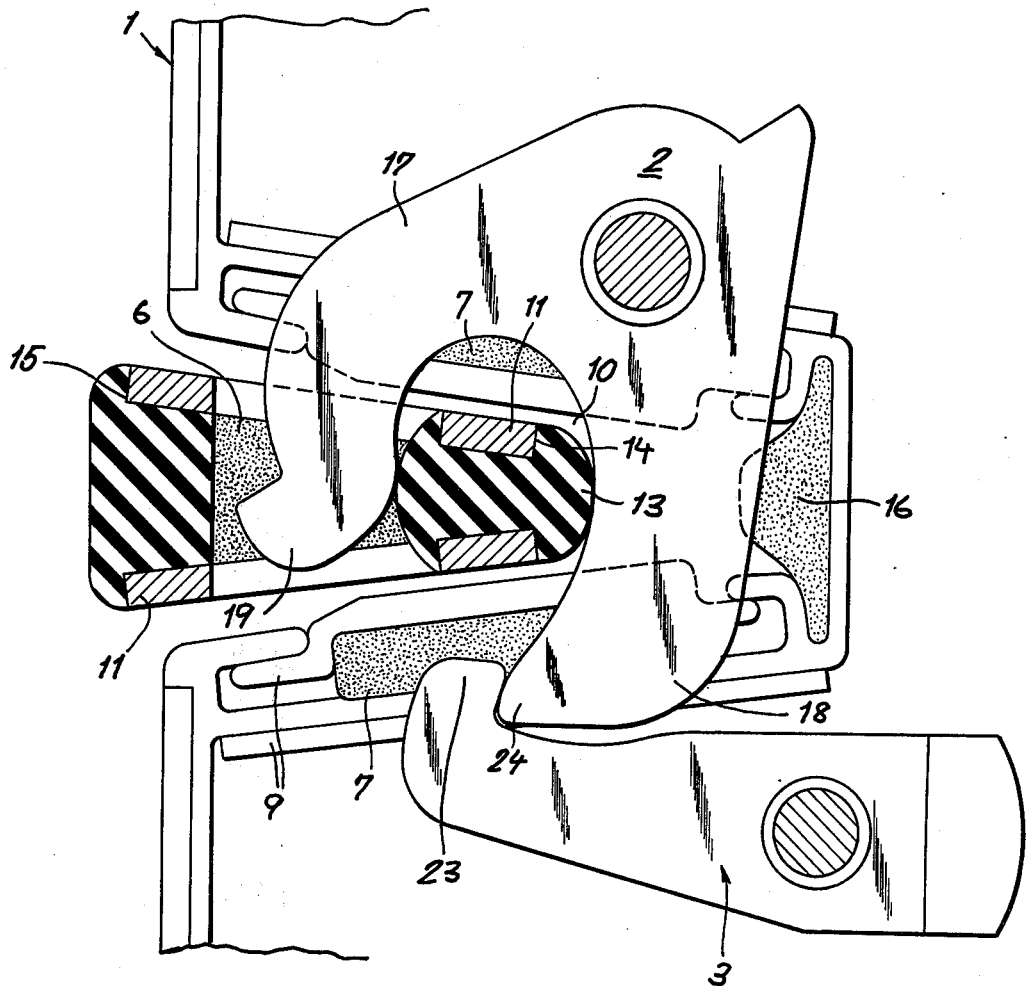
FIGS. 2 and 3 are views similar to FIG. 1 showing the latch in partially and fully closed positions, respectively.
Figure 3:
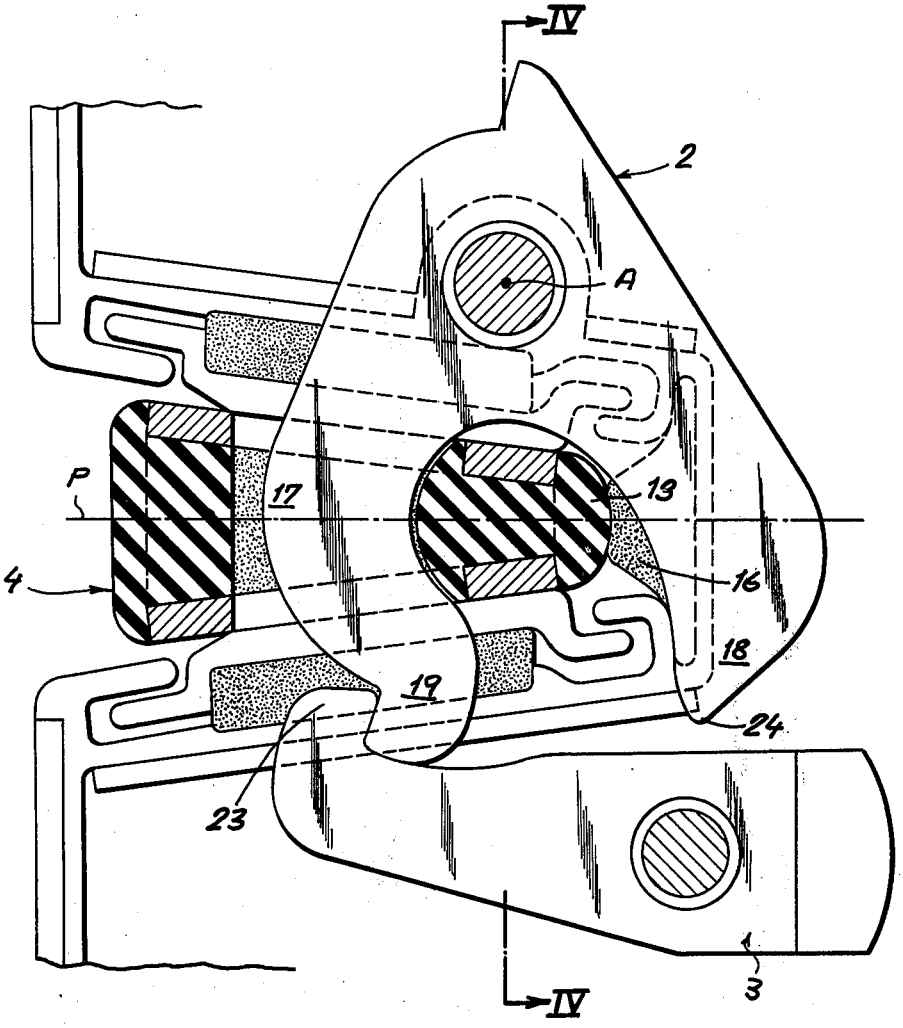

The latch mechanism itself is comprised basically as described above of the fork 2 and pawl 3. The fork 2 has relative to the motor vehicle an inner arm 17 with a tip 19 and another arm 18 with a tip 24. The pawl 3 has a tip 23 hookable on either of these ends 24 or 19 and the housing is formed with a guide slot 20 in which these ends may engage in the intermediate and closed positions shown in FIGS. 2 and 3 respectively. When the door is open the pawl 2 is in the position shown in FIG. 1. As it closes the bumper or damper body 13 of the bolt 6 first engages the outer arm 18 of the fork 2 to pivot it counterclockwise as shown in FIG. 1 about its axis A. After a predetermined limited travel as shown in FIG. 2 the arm 18 is pushed back far enough that its tip 24 is engaged and locked by the tip 23 of the pawl 3, and the arm 17 is engaged partly through the hole 6. In this intermediate position the door of the vehicle, not completely locked, is securely enough held to prevent accidental opening.

A further displacement of the door toward the bolt 4 will further pivot the fork 2 outwardly until its tip 19 engages behind the tip 23 of the pawl 3. In this position, therefore, the arm 17 is engaged completely through the hole 6 so as tightly to lock the door post 21 and door 22 together. In this position the outer flanks of the legs 11 rest tightly against the guide surfaces 8, and the outer end of the elastomeric body 13 bears resiliently against the bumper 16. Thus the door is tightly held shut.

It is noted in accordance with this invention that limited relative displacement of the door through a distance L indicated in FIG. 4 is possible due to the relatively great length B (FIG. 5) of the bolt 4. Thus even if the door and the doorpost are not perfectly centered relative to each other the door will still be able to close and lock effectively. The hole 4 also has a horizontal dimension C which is equal to at least twice the dimension D of the fork arm 17 and exceeds this dimension by at least 2 L, so that considerable allowance for misalignment is provided.

I claim:

1. A motor-vehicle door latch comprising:

a latch housing mountable on a motor-vehicle door;

at least one elastomeric guide in said housing forming therein an outwardly opening and outwardly flared seat having a pair of relatively inclined sides;

a locking fork pivotal in said housing between a freeing position clear of said seat and a locking position extending at least partially across said seat; and a bolt mountable on a motor-vehicle doorpost and formed of a U-section metal plate having a pair of legs inclined like said sides toward each other inwardly toward said housing and a bight joining said legs, said bolt being snugly fittable within said seat with said legs snugly engaging said sides, at least one of said sides being formed with a recess in which said fork is engageable in said locking position.

2. The latch defined in claim 1, further comprising an elastomeric body in said bolt between said legs thereof and projecting inwardly and outwardly therefrom.

3. The latch defined in claim 2 wherein said housing is provided with an elastomeric bumper at the base of said seat engageable with said elastomeric body.

4. The latch defined in claim 3 wherein said fork has a pair of arms one of which is engageable completely through said bolt at said recess in said locking position.

5. The latch defined in claim 4 wherein said housing is formed with a guide slot in which said arms are engageable in said locking position.

6. The latch defined in claim 5 wherein said fork is pivotal between its said positions.

7. The latch defined in claim 3 wherein said legs are planar and said recess is a vertically throughgoing hole.

8. The latch defined in claim 7 wherein said legs like said sides lie at an angle of between 10° and 20° to each other.

9. The latch defined in claim 8 wherein a horizontal plane bisects the angle between said legs and between said sides.

10. The latch defined in claim 7 wherein said hole has a width to at least twice the thickness of said fork.

* * * * *